US005132151A

United States Patent [19]

Graney

[11] Patent Number: 5,132,151

[45] Date of Patent: Jul. 21, 1992

[54] MULTI-LAYER COVER

[75] Inventor: Daniel J. Graney, Brazil, Ind.

[73] Assignee: Tredegar Industries, Inc., Richmond, Va.

[21] Appl. No.: 610,394

[22] Filed: Nov. 7, 1990

[51] Int. Cl.[5] ..... A61F 13/02

[52] U.S. Cl. ..... 428/40; 428/36.92; 428/138; 428/172; 428/215; 428/516; 219/10.55 E; 426/107; 426/118; 206/484; 206/484.1; 206/484.2

[58] Field of Search ..... 428/138, 40, 220, 76, 428/36.92, 167, 172, 178, 163, 215, 516; 206/484, 484.1, 484.2; 426/107, 118, 111, 113, 234, 243, 415, 418, 419, 127, 396; 220/359, 360, 361, 367, 369, 913; 219/10.55 E, 10.55 F, 10.55 M

[56] References Cited

U.S. PATENT DOCUMENTS

| | | | |
|---|---|---|---|
| D. 268,962 | 5/1983 | Adams et al. | D29/1.1 |
| 1,407,688 | 2/1922 | Banton | 220/913 |
| 3,154,225 | 10/1964 | Wadlinger | 206/631 |
| 3,543,750 | 12/1970 | Meizanis | 428/138 |
| 4,055,672 | 10/1977 | Hirsch | 426/396 |
| 4,252,516 | 2/1981 | Raley et al. | 425/290 |
| 4,263,357 | 4/1981 | Holson | 428/138 |
| 4,285,998 | 8/1981 | Thibedeau | 428/35 |
| 4,321,997 | 3/1982 | Miller | 428/138 |
| 4,469,741 | 9/1984 | Akao | 428/214 |
| 4,487,791 | 12/1984 | Komatsu et al. | 428/35 |
| 4,489,119 | 12/1984 | Ishige et al. | 428/167 |
| 4,505,770 | 3/1985 | Larimore | 156/235 |
| 4,524,095 | 6/1985 | Gockel et al. | 428/43 |
| 4,535,020 | 8/1985 | Thomas | 428/131 |
| 4,590,109 | 5/1986 | Holmberg | 428/40 |
| 4,592,714 | 6/1986 | Kuchenbecker | 426/118 |
| 4,985,606 | 1/1991 | Faller | 426/107 |

FOREIGN PATENT DOCUMENTS

| | | | |
|---|---|---|---|
| 1503913 | 3/1978 | United Kingdom | 426/84 |

*Primary Examiner*—Ellis P. Robinson
*Assistant Examiner*—Nasser Ahmed
*Attorney, Agent, or Firm*—Emch, Schaffer, Schaub & Porcello Co.

[57] ABSTRACT

A multi-layer cover for use on a container is disclosed. The cover includes a first layer defining a plurality of openings. A second layer is removably attached to the first layer. Upon removal of the second layer, fluids or aromas from the container can pass through the openings in the first layer.

22 Claims, 2 Drawing Sheets

MULTI-LAYER COVER

BACKGROUND OF THE INVENTION

The present invention is directed to a multi-layer cover which is utilized on a container.

When containers are used in connection with microwave ovens, if a solid film cover is placed on the container, as is well known, holes must be placed within the cover by the user to allow steam to escape from the container. If the holes are not placed in this continuous film, the film has a tendency to expand and possibly explode.

If holes are initially placed in the cover film, the contents of the container are subject to oxidation and deterioration, prior to their use. One way of preventing such deterioration is to take the entire unit consisting of the container and perforated cover and place it inside of another bag or container which is sealed. While this solves the deterioration problem, it is an expensive solution.

The present invention is not restricted to microwave or cooking uses. The cover of the invention has utility in any packaging application where contents require protection from environmental contamination and where the integrity of the package contents must be maintained until the cover is removed.

A primary object of the present invention is to provide a multi-layer cover for use on a container wherein one or more layers may be peeled or removed from the remaining layer or layers. The remaining layers are perforated. Upon removal of the peelable portion, fluids or aromas can pass through the openings.

A further object of the present invention is to provide a multi-layer cover for use on a containers which provides an overall container-cover assembly in which the contents are not subject to deterioration before use.

SUMMARY OF THE INVENTION

The present invention is directed to a multi-layer cover for use on a container. The multi-layer cover includes a first layer having a plurality of openings extending therethrough. A second layer is removably attached to the first layer. The second layer closes the openings of the first layer. Upon removal of the second layer, fluids, gases or aromas can pass through the openings in the first layer.

DESCRIPTION OF THE PREFERRED EMBODIMENTS

Figure 1:
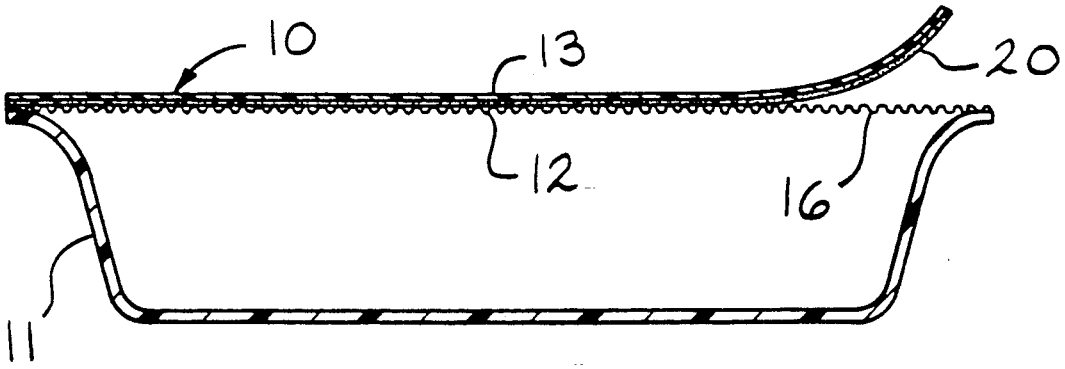
FIG. 1 is a diagrammatic cross-sectional view of a multi-layer cover, according to the present invention, in position on a microwave container and showing a barrier portion being removed.

Referring to FIG. 1, a multi-layer cover, according to the present invention, is generally indicated by the reference number 10. As used in the present specification and claims, the term "multi" means two or more. A "layer" may be comprised of a single sheet of film or material or several sheets joined together to form an overall composite unit or layer. In the FIG. 1 embodiment, the cover 10 is positioned on a microwave container 11. It is well known with respect to microwave containers, that the cover must be perforated to allow steam to pass through the cover during the cooking process. However, if the cover is initially perforated, the food within the microwave container tends to oxidize or otherwise deteriorate.

Figure 2:
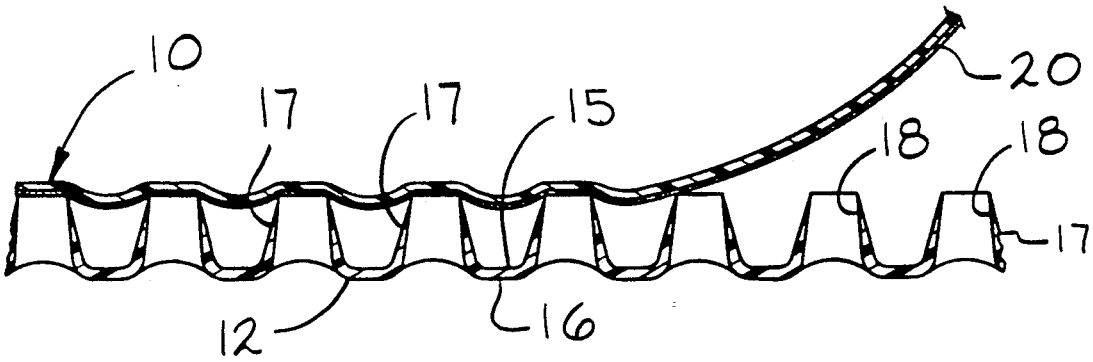
FIG. 2 is an enlarged cross-sectional view showing a portion of the multi-layer cover, shown in FIG. 1.

The cover 10, according to the present invention, includes a first layer 12 and a second layer 13. Referring to FIG. 2, in the present embodiment, the first layer 12 ha an upper surface 15 and a lower surfaced 16. A plurality of protuberances 17 extend outwardly from one of the surfaces. In the present embodiment, protuberances 17 extend outwardly from the upper surface 15. A plurality of openings 18 are defined through the first layer 12 adjacent the protuberances. While in the present embodiment, the openings 18 are defined adjacent the upper end so the protuberances 17, in other embodiments, the openings may be defined in the valleys between the protuberances 17. Examples of films having the desired protuberances and openings are disclosed in U.S. Pat. Nos. 4,535,020 and DES 268,962.

The first layer 12 is preferably a perforated thermoplastic film, such as an olefin film. Polyethylene, polypropylene and nylons together with polyethylene blends may be used to form the first layer 12.

The second layer 13 is a continuous or solid thermoplastic layer which is removably connected to the first layer 12. In the present embodiment, this connection is made by an intermediate adhesive layer 20. When desired, the second layer 13 is peeled or removed from the first layer 12 to expose the openings 18 in the first layer 12. It has been found that the protuberances 17 defined in the first layer 12, restrict the adherence of layer s 12 and 13, so that the second layer is more readily peelable When the second layer 13 is positioned adjacent the upper ends of the protuberances 17, there is a tendency for a mechanical connection between the second layer 13 and the first layer 12. It is likely the joining of the layers 12 and 13 involves some degree of pressure, which collapses the protuberances 17 in a manner, which is similar to a rivet, connects the first layer 12 to the second layer 13.

In other embodiments, the intermediate adhesive layer 20 may be omitted. Coextrusion of the first and second layers 12 and 13 result in a connection or adhesion which is strong enough to removably join the layers 12 and 13 together until removal of the second layer 13 is desired. In the embodiment shown in FIGS. 1 and 2, the first layer 12 is a polypropylene layer, while the barrier or second layer 13 is a nylon layer. However, the second layer 13 can be constructed of various other materials. These materials include high density polyethylene, high density polyethylene combined with nylon, nylon alone, polyethylene terephthalate, a combination of polyethylene terephthalate combined with ionomer resins (SURLYN ®) or polyethylene acetate.

Outlined below is a chart which indicates preferred combinations of materials for the first perforated layer 12 as the second barrier layer 13. In a microwave application, the fist layer 12 is normally constructed of a monolayer polypropylene with the barrier or second layer 13 comprises a nylon. A thin bonding layer or adhesive joins the layers 12 and 13.

While there are many other combinations of materials which can be used to construct a multi-layer cover, according to the present invention, the following table covers a relatively small range of possibilities.

| FIRST LAYER (Perforate) | | SECOND LAYER (Barrier) | |
|---|---|---|---|
| Other layer(s) | contact layer adjacent 2nd layer | contact layer adjacent 1st layer | other layer(s) |
| (1) | nylon 6 | HDPE or MDPE | adhes. nylon 6 |
| (2) MD/adhes. | nylon 6 | HDPE | |
| (3) | PE, PP, or blnd | nylon 6 | |
| (4) | PE blend | PET | |
| (5) | PE blend | IR | |
| (6) PE blend | nylon 6 | BR | PET, or PA |

Where:

MD or MDPE=medumdensitypolyethyelen

PE=polyethyelene

PP=polypropoylene

HDPE=high density polyethylene

PET=polyethyelen terephthalate

IR=ionomer resins (SELAR ®)

BR=resins (SURLYN ®)

PE blends consist of various percentages of LDPE, LLDPE, MDPE, HPPE and other polyethylene-based concentrates known in the art.

As indicated above in the chart, either the first layer 12 or the second layer 13 may include more than one material or layer. The above chart designates materials having the desired contact properties between the first and second layers 12 and 13 to provide the necessary degree of adherence so that the second layer 13 may be peeled away from the first layer 12.

Referring to FIG. 1, after the second or barrier layer 13 ia peeled from the first or perforated layer 12, steam may escape during the heating of food within the container 11. The first layer 12 also serves as a splatter shield of prevent material from leaving the container and splattering the interior of the microwave oven.

Figure 3:
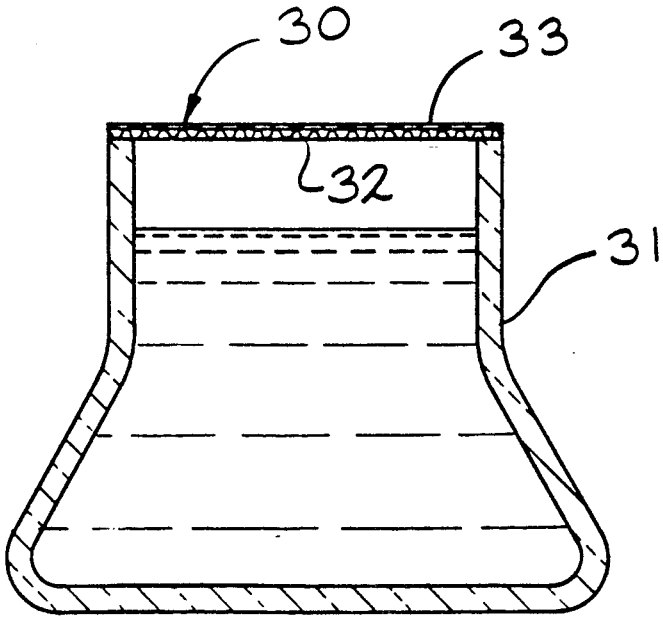
FIG. 3 is another embodiment of a multi-layer cover positioned on a container for holding aromatic materials.

Referring to FIG. 3, another embodiment of a multi-layer cover, according to the present invention, is generally indicated by the reference number 30. The cover 30 is positioned on the open end of a container, which in the present embodiment is a glass bottle 31. The glass bottle 31 holds air freshening liquid. The multi-layer cover 30 includes a perforated first layer 32 and a barrier second layer 33. The first layer 32 is constructed of a polypropylene and the barrier second layer 33 is constructed of a nylon. The second layer 33 is removably connected to the first layer 32. During use, the second layer 33 is removed or peeled from the first layer 32. The aromatic fumes from the glass bottle 31 are then free to pass through the openings in the first layer 32.

Aromas, as used herein, normally consists of gaseous substances, whether they are vapors or true gases. Vapors as used herein are often present in the gaseous phase, but generally exist as a liquid at room temperature. A gas generally exists in the gaseous phase at room temperature.

Figure 4:
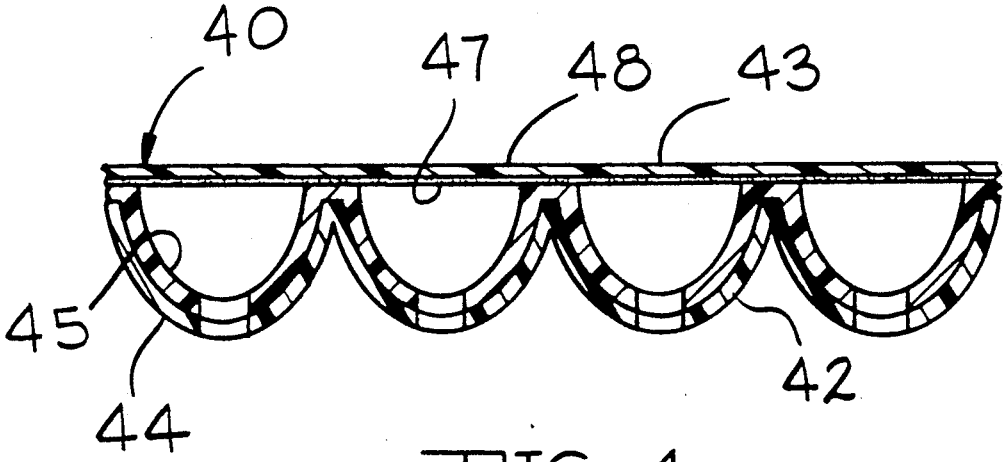
FIG. 4 is a fragmentary cross-sectional view another embodiment of a multi-layer cover, according to the present invention.

Referring to FIG. 4, another embodiment of the multi-layer cover, according to the present invention, is generally indicated by the reference number 40. The cover 40 includes a perforated first layer 42 and a barrier second layer 43 which is removably attached to the fist layer 42. The firs layer 42 comprises two layers which are coextruded. The lower layer 44 is a polyethylene blend while the upper layer 45 is a nylon, for example nylon 6. The second continuous or barrier layer 43 is also comprised of two coextruded layers consisting of a lower layer 47 of a Surlyn material. An upper layer 48 is constructed of polyethylene tertathelate or polyethylene acetate.

Figure 5:
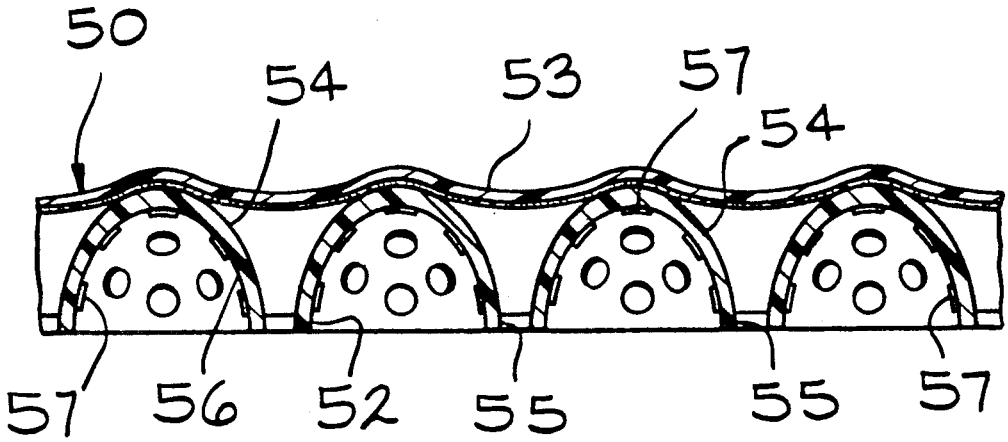
FIG. 5 is a fragmentary cross-sectional view of still another embodiment of a multi-layer cover, according to the present invention.

Referring to FIG. 5, still another embodiment of a multi-layer cover, according to present invention, is generally indicated by the reference number 50. The multi-layer cover 50 includes a first perforated layer 52 and a second barrier layer 53 removably attached to the first layer 52. The first layer 52 defines a plurality of protuberances 54 and a plurality of openings 55. The first perforated layer 52 includes a lower surface 56. A plurality of metallic particles 57 are positioned on the lower surface 56 of the first layer 52. In other embodiments, rather than using metallic particles 57, a metal layer, for example an aluminum layer is dispersed on either the lower or upper surface of the fist layer 52.

The film thickness of the layers depend upon the end use of the package or container. The barrier films or layers, including the second layers 13, 33, 43 nd 53, normally fall within a thickness range between 1 mil and 6 mil. A 2 mil thickness is a typical thickness.

If the first layer includes protuberances, the thickness is referred to as the "ET" (embossed or effective thickness). The perforated layers, including the first layers 12, 32, 42 and 52, normally have an actual layer thickness of between 1.5 ml and 3.0 ml. The ET range for the first layers are between 14 mil and 50 mil. A 22 mil thickness is a typical ET.

The multi-layer cover, according to the present invention, may be used on various containers where an initial seal structure is required to retard oxidation and a second perforated structure is required to allow the passage of gases or liquids.

Many revisions may be made to the embodiments disclosed above without departing from the scope of the following claims.

I claim:

1. A multi-layer cover for use on a container comprising, in combination, a first layer having upper and lower surfaces, said first layer having a plurality of protuberances extending outwardly from said upper surface, a plurality of openings extending through said first layer in said protuberances, said protuberances having upper and lower ends, a second layer positioned adjacent said upper end of said protuberances, said second layer removably attached to said first layer by a mechanical connection formed by pressure bonding said layers, said second layer closing said openings in said first layer, whereby upon removal of said second layer fluids, gases or aromas can pass through said openings in said first layer.

2. A multi-layer cover, according to claim 1, including an adhesive layer positioned between said first layer and said second layer.

3. A multi-layer cover, according to claim 1, including a metallic portion on one of said surfaces of said first layer.

4. A multi-layer cover, according to claim 1, wherein said first layer is a nylon layer.

5. A multi-layer cover, according to claim 1, wherein said first layer is a polyethylene layer.

6. A multi-layer cover, according to claim 1, wherein said first layer is a polypropylene layer.

7. A multi-layer cover, according to claim 1, wherein said first layer is a laminated of medium density polyethylene and nylon.

8. A multi-layer cover, according to claim 1, wherein said first layer is a laminate of polyethylene and polypropylene.

9. A multi-layer cover, according to claim 1, wherein said first layer is constructed of a polyethyelene blend.

10. A multi-layer cover, according to claim 1, wherein said first layer is a laminate of a polyethylene blend and nylon.

11. A multi-layer cover, according to claim 4, wherein said second layer is a high density polyethylene.

12. A multi-layer cover, according to claim 4, wherein said second layer is a laminate of a medium density polyethylene and nylon.

13. A multi-layer cover, according to claim 7, wherein said second layer is a high density polyethylene.

14. A multi-layer cover, according to claim 8, wherein said second layer is nylon.

15. A multi-layer cover, according to claim 9, wherein said second layer is polyethylene terephthalate.

16. A multi-layer cover, according to claim 12, wherein said second layer is a polyethyelene acetate.

17. A multi-layer cover, according to claim 1, wherein said first layer comprises at least two materials.

18. A multi-layer cover, according to claim 3, wherein said second layer comprises at least two materials.

19. A multi-layer cover for use on a microwave container comprising, in combination, a first layer having upper and lower surfaces, said first layer having a plurality of protuberances extending outwardly from said upper surface, a plurality of openings extending through said first layer in said protuberances, said protuberances having upper and lower ends, said first layer being constructed from a monolayer polypropylene, a second layer positioned adjacent said upper ends of said protuberances, said second layer removably attached to said first layer by a mechanical connection formed by pressure bonding said layers, said second layer closing said openings in said first layer, said second layer being constructed from a nylon, whereby upon removal of said second layer fluids, gases or aromas can pass through said openings in said first layer.

20. A multi-layer cover, according to claim 19, wherein said second layer has a thickness range between 1 mil and 6 mil.

21. A multi-layer cover, according to claim 20, wherein said first layer has an effective thickness between 14 mil and 50 mil.

22. A multi-layer cover, according to claim 19, including an adhesive layer positioned between said first layer and said second layer.

* * * * *